US007351903B2

(12) United States Patent
Ishida et al.

(10) Patent No.: US 7,351,903 B2
(45) Date of Patent: Apr. 1, 2008

(54) MUSICAL COMPOSITION DATA EDITING APPARATUS, MUSICAL COMPOSITION DATA DISTRIBUTING APPARATUS, AND PROGRAM FOR IMPLEMENTING MUSICAL COMPOSITION DATA EDITING METHOD

(75) Inventors: Kenji Ishida, Shizuoka-ken (JP); Kenichi Miyazawa, Shizuoka-ken (JP); Yoshitaka Masumoto, Aichi-ken (JP); Yoshiki Nishitani, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 374 days.

(21) Appl. No.: 10/629,356

(22) Filed: Jul. 29, 2003

(65) Prior Publication Data

US 2004/0020348 A1 Feb. 5, 2004

(30) Foreign Application Priority Data

Aug. 1, 2002 (JP) ..... 2002-225086

(51) Int. Cl.
*G10H 1/00* (2006.01)

(52) U.S. Cl. ..... 84/600; 84/613; 84/633; 84/636; 84/665

(58) Field of Classification Search ..... 84/600–608, 84/612, 613–633, 636, 665, 668
See application file for complete search history.

(56) References Cited

U.S. PATENT DOCUMENTS 5,179,240 A * 1/1993 Mizuno et al. ..... 84/613
6,198,034 B1 * 3/2001 Beach et al. ..... 84/600

FOREIGN PATENT DOCUMENTS

JP 10-260681 * 9/1998

OTHER PUBLICATIONS

Cakewalk Professional for Windows (Release 2.0) User's Guide. Published by Twelve Tone Systems, Inc. 1992.*

* cited by examiner

*Primary Examiner*—Lincoln Donovan
*Assistant Examiner*—David S. Warren
(74) *Attorney, Agent, or Firm*—Harness, Dickey & Pierce, PLC

(57) ABSTRACT

There is provided a musical composition data editing apparatus which enables the generation of musical composition data using which a user can cause his/her own musical image to be reflected to a high degree in a musical composition performance through simple operations, whereby a wide variety of users from beginners having no knowledge of musical composition data such as MIDI data to experts who want to arrange musical compositions in their own manner can be satisfied. A standard musical composition data generating section 230 of a contents server CS refers to musical composition reproduction control codes for controlling reproduction of a musical composition contained in source musical composition data, to determine whether or not a musical image in the musical composition reproduction changes. When it is determined that the musical image in the musical composition reproduction changes, rewriting of the musical composition reproduction control codes is carried out such that a musical composition reproduction state becomes constant.

12 Claims, 12 Drawing Sheets

<MUSICAL COMPOSITION DATA LIST R>

| NAME OF PIECE OF SOURCE MUSICAL COMPOSITION DATA | NAME OF PIECE OF STANDARD MUSICAL COMPOSITION DATA |
|---|---|
| a | a' |
| b | b' |
| c | c' |
| ⋮ | ⋮ |

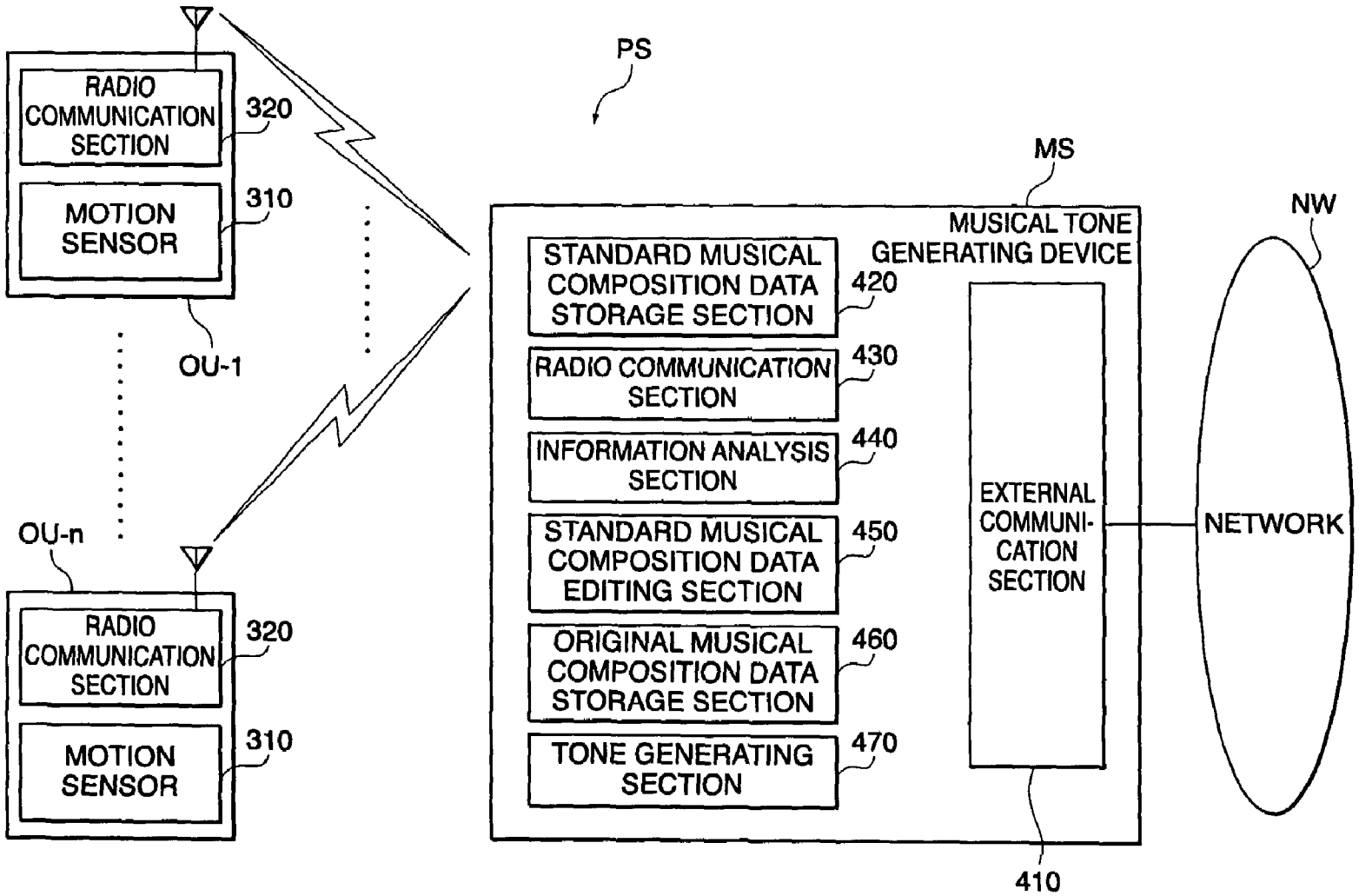
FIG. 8
PS
MS
MUSICAL TONE GENERATING DEVICE
NW
NETWORK
EXTERNAL COMMUNI-CATION SECTION
410
STANDARD MUSICAL COMPOSITION DATA STORAGE SECTION
420
RADIO COMMUNICATION SECTION
430
INFORMATION ANALYSIS SECTION
440
STANDARD MUSICAL COMPOSITION DATA EDITING SECTION
450
ORIGINAL MUSICAL COMPOSITION DATA STORAGE SECTION
460
TONE GENERATING SECTION
470
RADIO COMMUNICATION SECTION
320
MOTION SENSOR
310
OU-1
OU-n

MUSICAL COMPOSITION DATA EDITING APPARATUS, MUSICAL COMPOSITION DATA DISTRIBUTING APPARATUS, AND PROGRAM FOR IMPLEMENTING MUSICAL COMPOSITION DATA EDITING METHOD

BACKGROUND OF THE INVENTION

1. Field of the Invention

The present invention relates to a musical composition data editing apparatus for generating standard musical composition data suitable for use in musical composition data editing, a musical composition data distributing apparatus, and a program for implementing a musical composition data editing method.

2. Description of the Related Art

Users who like listening to the performance of musical compositions often do not merely want to listen to and enjoy a reproduced musical composition, but rather wish the musical composition to be performed in accordance with their own musical image.

To realize this user wish, musical composition performance systems that control performance parameters such as performance tempo and volume in accordance with the user's motion have been proposed. Such a musical composition performance system is comprised, for example, of operating terminals operated by various users, and a musical tone generating device that controls the performance parameters such as the volume according to the motion of the users operating the operating terminals, and generates musical tones based on the controlled performance parameters. Each user carries out operations of moving his/her operating terminal horizontally, vertically and so on in accordance with his/her own musical image. The operations are transmitted from the operating terminal to the musical tone generating device as motion information, and musical tones for which the volume and so on are controlled based on the motion information are sounded from the musical tone generating device.

According to such a musical composition performance system, the user can cause a musical composition to be performed in accordance with his/her own musical image. However, most musical composition data used during such musical composition performance (e.g. MIDI (Musical Instrument Digital Interface) data, etc.) is created with an intention of being performed automatically by a MIDI musical instrument or the like. Such pre-existing musical composition data contains various control codes (e.g. musical composition reproduction control codes for controlling performance parameters such as performance tempo and volume, and acoustic control codes for controlling acoustics such as pan and reverberation, etc.) for realizing the musical image of the creator of the musical composition data. There has thus been a problem that, when a user carries out performance of a musical composition based on such musical composition data, the user cannot cause his/her own musical image to be reflected in the musical composition performance adequately.

SUMMARY OF THE INVENTION

It is an object of the present invention to provide a musical composition data editing apparatus, a musical composition data distributing apparatus, and a program for implementing a musical composition data editing method, which enable the generation of musical composition data using which a user can cause his/her own musical image to be reflected to a high degree in a musical composition performance through simple operations, whereby a wide variety of users from beginners having no knowledge of musical composition data such as MIDI data to experts who want to arrange musical compositions in their own manner can be satisfied.

To attain the above object, in a first aspect of the present invention, there is provided a musical composition data editing apparatus comprising a determining device that refers to musical composition reproduction control codes for controlling reproduction of a musical composition contained in source musical composition data, to determine whether or not a musical image in the musical composition reproduction changes, and a rewriting device that is responsive to it having been determined by the determining device that the musical image in the musical composition reproduction changes, for carrying out rewriting of the musical composition reproduction control codes such that a musical composition reproduction state becomes constant.

According to the first aspect of the present invention, if it is determined that the musical image in the musical composition reproduction based the musical composition data changes, then rewriting of musical composition reproduction control codes is carried out such that the musical composition reproduction state (e.g. performance tempo, volume, etc.) becomes constant.

As a result, through the rewriting of the musical composition reproduction control codes being carried out such that standard musical composition data is generated, and by using this standard musical composition data, a user can freely arrange the musical composition in question through relatively simple operations. In other words, because the musical composition is controlled such that the performance tempo, the volume and so on do not change during reproduction of the musical composition, problems such as it not being possible for a user to change the performance tempo, the volume and so on as he/she wishes can be avoided.

Preferably, the musical composition reproduction control codes referred to by the determining device include performance tempo control codes, and the rewriting device is responsive to it having been determined by the determining device that a performance tempo in the musical composition reproduction changes, for carrying out rewriting of the performance tempo control codes such that the performance tempo becomes constant.

Preferably, the musical composition reproduction control codes referred to by the determining device include volume control codes, and the rewriting device is responsive it having been determined by the determining device that a volume in the musical composition reproduction changes, for carrying out rewriting of the volume control codes such that the volume becomes constant.

To attain above object, in a second aspect of the present invention, there is provided a program for implementing a musical composition data editing method, comprising a determining module for referring to musical composition reproduction control codes for controlling reproduction of a musical composition contained in source musical composition data, to determine whether or not a musical image in the musical composition reproduction changes, and a rewriting module responsive to it having been determined by the determining module that the musical image in the musical composition reproduction changes, for carrying out rewriting of the musical composition reproduction control codes such that a musical composition reproduction state becomes constant.

To attain above object, in a third aspect of the present invention, there is provided a musical composition data editing apparatus comprising a determining device that determines whether or not acoustic control codes for controlling acoustics are contained in source musical composition data, and a control code rewriting device that is responsive to it having been determined by the determining device that the acoustic control codes are contained in the source musical composition data, for carrying out rewriting of the acoustic control codes such that acoustics in reproduction of a musical composition contained in the source musical composition data becomes constant.

To attain above object, in a fourth aspect of the present invention, there is provided a program for implementing a musical composition data editing method, comprising a determining module for determining whether or not acoustic control codes for controlling acoustics are contained in source musical composition data, and a control code rewriting module responsive to it having been determined by the determining module that the acoustic control codes are contained in the source musical composition data, for carrying out rewriting of the acoustic control codes such that the acoustics in reproduction of a musical composition contained in the source musical composition data become constant.

To attain above object, in a fifth aspect of the present invention, there is provided a musical composition data distributing apparatus for distributing musical composition data to at least one performing apparatus, comprising a control code deleting device that is operable when at least one of musical composition reproduction control codes for controlling musical composition reproduction and acoustic control codes for controlling acoustics is contained in source musical composition data, for deleting at least one of the musical composition reproduction control codes and the acoustic control codes from the source musical composition data to generate standard musical composition data, and a distributing device that distributes the standard musical composition data to the performing apparatus.

According to the fifth aspect of the present invention, if it is determined that acoustic control codes for controlling acoustics such as reverberation have been imparted to the musical composition data, then the acoustic control codes are deleted so that acoustics such as reverberation are no longer imparted.

As a result, through the acoustic control codes for controlling the acoustics imparted to the musical composition being deleted, standard musical composition data is generated, and by using this standard musical composition data, a user can freely impart acoustics such as reverberation to the musical composition in question through relatively simple operations. In other words, because acoustics such as reverberation imparted to the musical composition in advance are deleted from the musical composition, problems such as it not being possible for a user to impart acoustics as he/she wishes can be avoided.

Preferably, the musical composition data distributing apparatus further comprises a notifying device that notifies distributable standard musical composition data to the performing apparatus in response to a request from the performing apparatus.

In a preferred form of the fifth aspect, the performing apparatus comprises a musical tone generating device that receives the standard musical composition data from the musical composition data distributing device, edits the received standard musical composition data, and generates musical tones based on the edited musical composition data, and at least one operating terminal carriable by an operator, that generates information for controlling editing of the standard musical composition data by the musical tone generating device, the operating terminal having a transmitting section that is operable during the editing of the standard musical composition data to detect motion of the operating terminal caused by an operation of the operator, generate motion information based on the detected motion, and transmit the motion information to the musical tone generating device, and the musical tone generating device having an imparting section that newly generates musical composition reproduction control codes and acoustic control codes based on the motion information received from the operating terminal, and imparts the generated musical composition reproduction control codes and acoustic control codes to the standard musical composition data.

To attain above object, in a sixth aspect of the present invention, there is provided a musical composition data distributing apparatus for distributing musical composition data to at least one performing apparatus, comprising a control code rewriting device that is operable when at least one of musical composition reproduction control codes for controlling musical composition reproduction and acoustic control codes for controlling acoustics is contained in source musical composition data and at least one of a musical image and acoustics in the musical composition reproduction changes, for carrying out rewriting of at least one of the musical composition reproduction control codes and the acoustic control codes such that at least one of a musical composition reproduction state and the acoustics becomes constant, to generate standard musical composition data, and a distributing device that distributes the standard musical composition data to the performing apparatus.

Preferably, the musical composition data distributing apparatus further comprises a notifying device that notifies distributable standard musical composition data to the performing apparatus in response to a request from the performing apparatus.

In a preferred form of the fifth aspect, the performing apparatus comprises a musical tone generating device that receives the standard musical composition data from the musical composition data distributing device, edits the received standard musical composition data, and generates musical tones based on the edited musical composition data, and at least one operating terminal carriable by an operator, that generates information for controlling editing of the standard musical composition data by the musical tone generating device, the operating terminal having a transmitting section that is operable during the editing of the standard musical composition data to detect motion of the operating terminal caused by an operation of the operator, generate motion information based on the detected motion, and transmit the motion information to the musical tone generating device, and the musical tone generating device having a rewriting section that newly generates musical composition reproduction control codes and acoustic control codes based on the motion information received from the operating terminal, and rewrites musical composition reproduction control codes and acoustic control codes contained in the standard musical composition data to be the newly generated musical composition reproduction control codes and acoustic control codes.

According to the present invention, it is possible to provide musical composition data able to satisfy a wide variety of users from beginners having no knowledge of musical composition data such as MIDI data to experts who want to arrange musical compositions in their own manner.

The above and other objects, features, and advantages of the invention will become more apparent from the following detailed description taken in conjunction with the accompanying drawings.

BRIEF DESCRIPTION OF THE DRAWINGS

FIG. 8 is a diagram showing the functional construction of a performing apparatus appearing in FIG. 1;

DETAILED DESCRIPTION OF THE PREFERRED EMBODIMENTS

The present invention will now be described in detail with reference to the drawings showing preferred embodiments thereof.

Figure 1:
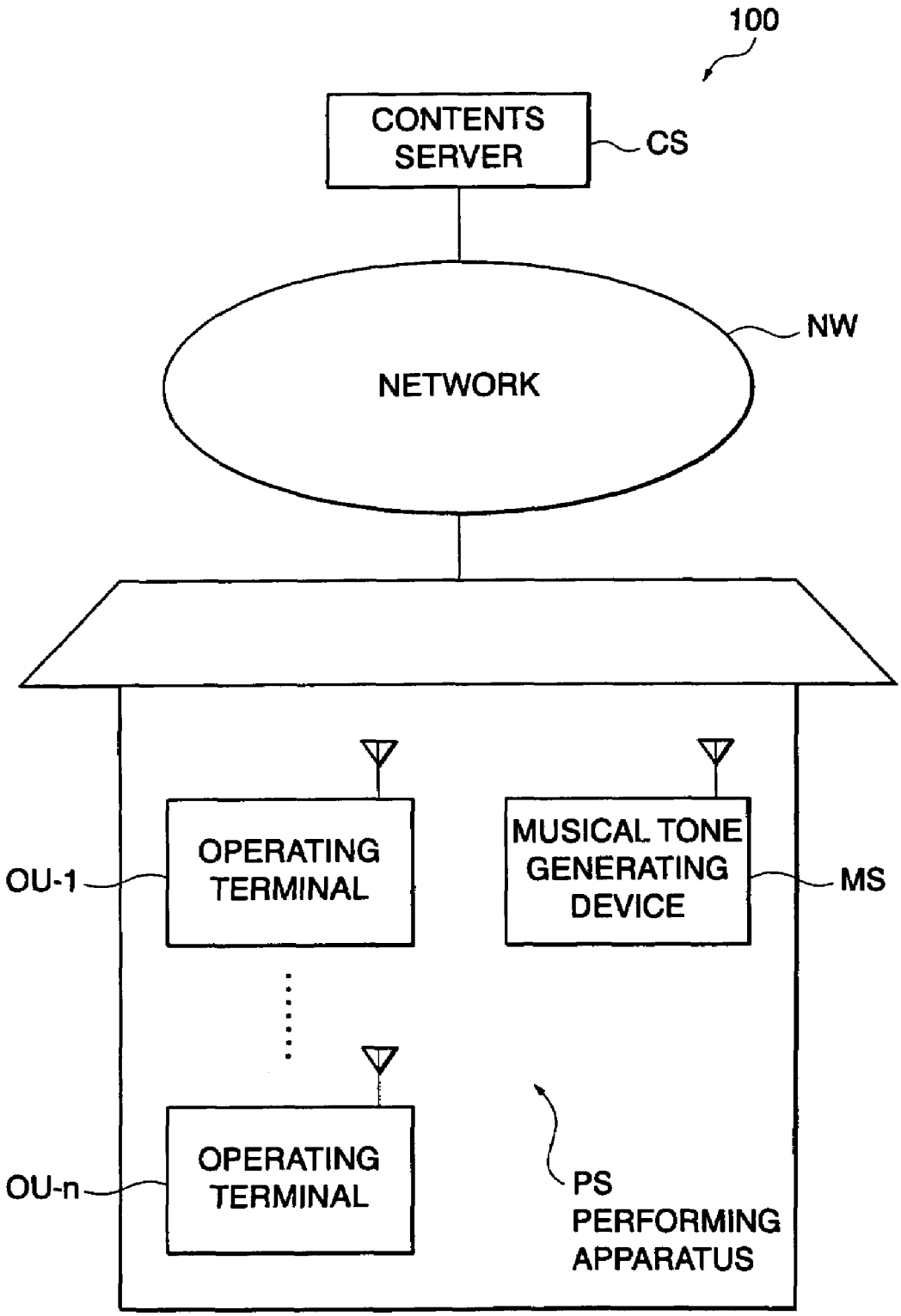
FIG. 1 is a diagram showing the construction of a system in which are implemented a musical composition data editing apparatus and a musical composition data distributing apparatus according to a first embodiment of the present invention.

FIG. 1 is a diagram showing the construction of a system 100 in which are implemented a musical composition data editing apparatus and a musical composition data distributing apparatus according to a first embodiment of the present invention.

The system 100 is comprised of a contents server CS (musical composition data editing apparatus, musical composition data distributing apparatus) that distributes standard musical composition data, described later, in response to requests from performing apparatuses PS or the like, a network NW that is comprised of any of various communication networks such as the Internet or a public telephone network, and performing apparatuses PS that receive standard musical composition data distributed from the contents server CS via the network NW, imparts various acoustic effects and so on to the received standard musical composition data, and carries out performance of the musical composition based on the musical composition data obtained by imparting the acoustic effects and so on. It should be noted that the system 100 will actually have a plurality of performing apparatuses PS, but in FIG. 1 only one performing apparatus PS is shown to prevent the figure from becoming too complicated.

A characteristic feature of the system 100 according to the present embodiment is the data structure of the standard musical composition data distributed by the contents server CS. The construction of the contents server CS will thus first be described, and the construction of the performing apparatuses PS will be described afterward.

Figure 2:
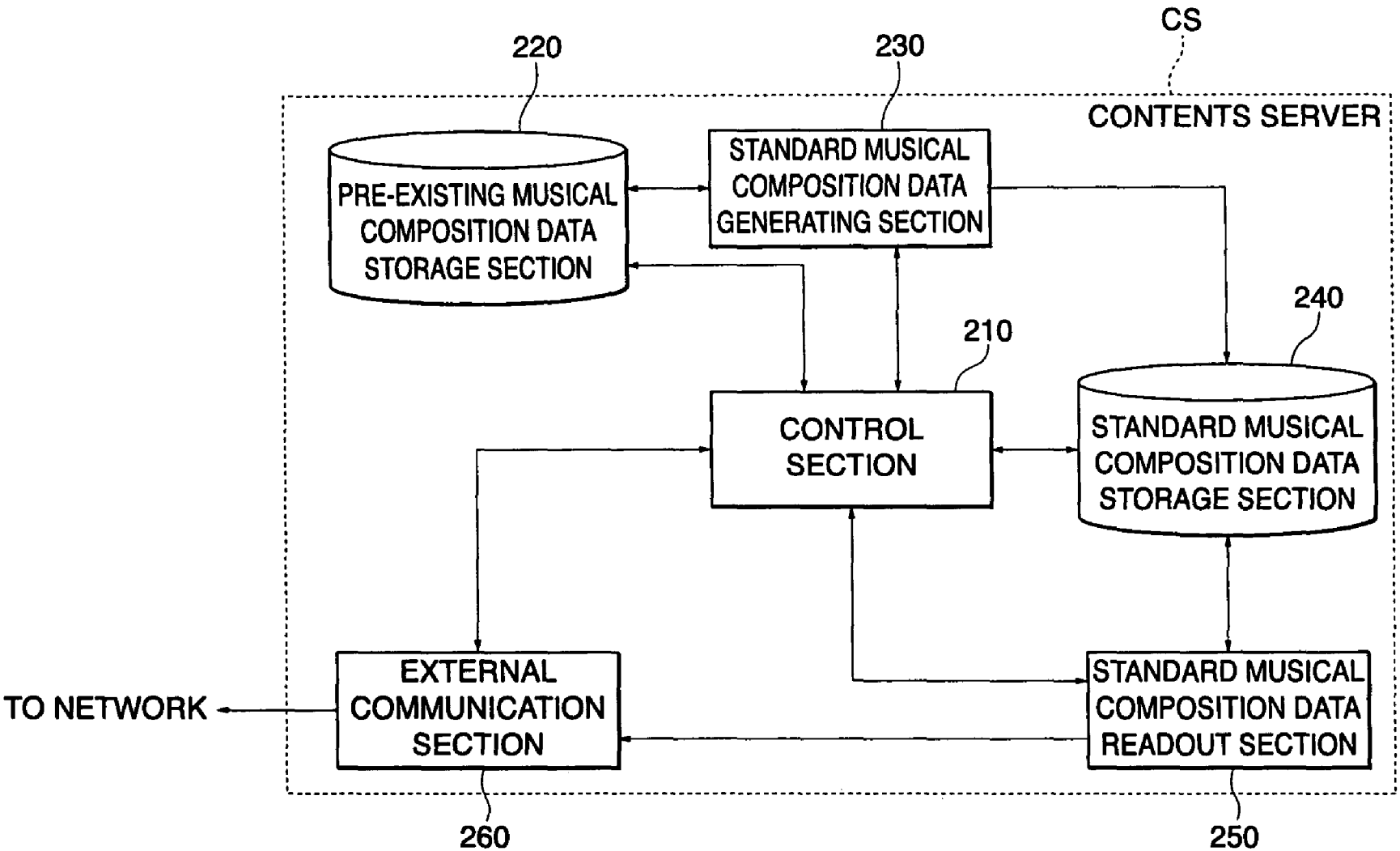
FIG. 2 is a block diagram showing the functional construction of a contents server appearing in FIG. 1.

FIG. 2 is a block diagram showing the functional construction of the contents server CS.

A control section 210 carries out centralized control of various sections of the contents server CS.

A pre-existing musical composition data storage section 220 stores pre-existing musical composition data (source musical composition data) comprised of MIDI data or the like, categorized, for example, by genre or artist.

Figure 3A:
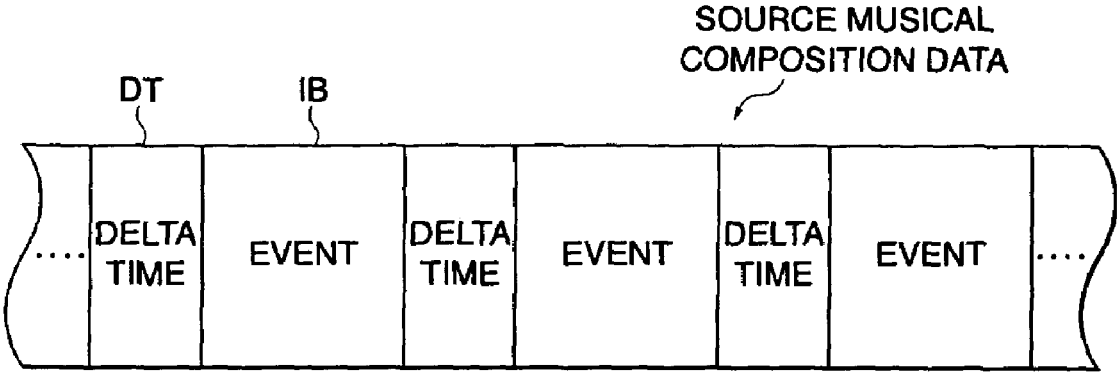
FIGS. 3A and 3B are diagrams useful in explaining source musical composition data.
Figure 3B:
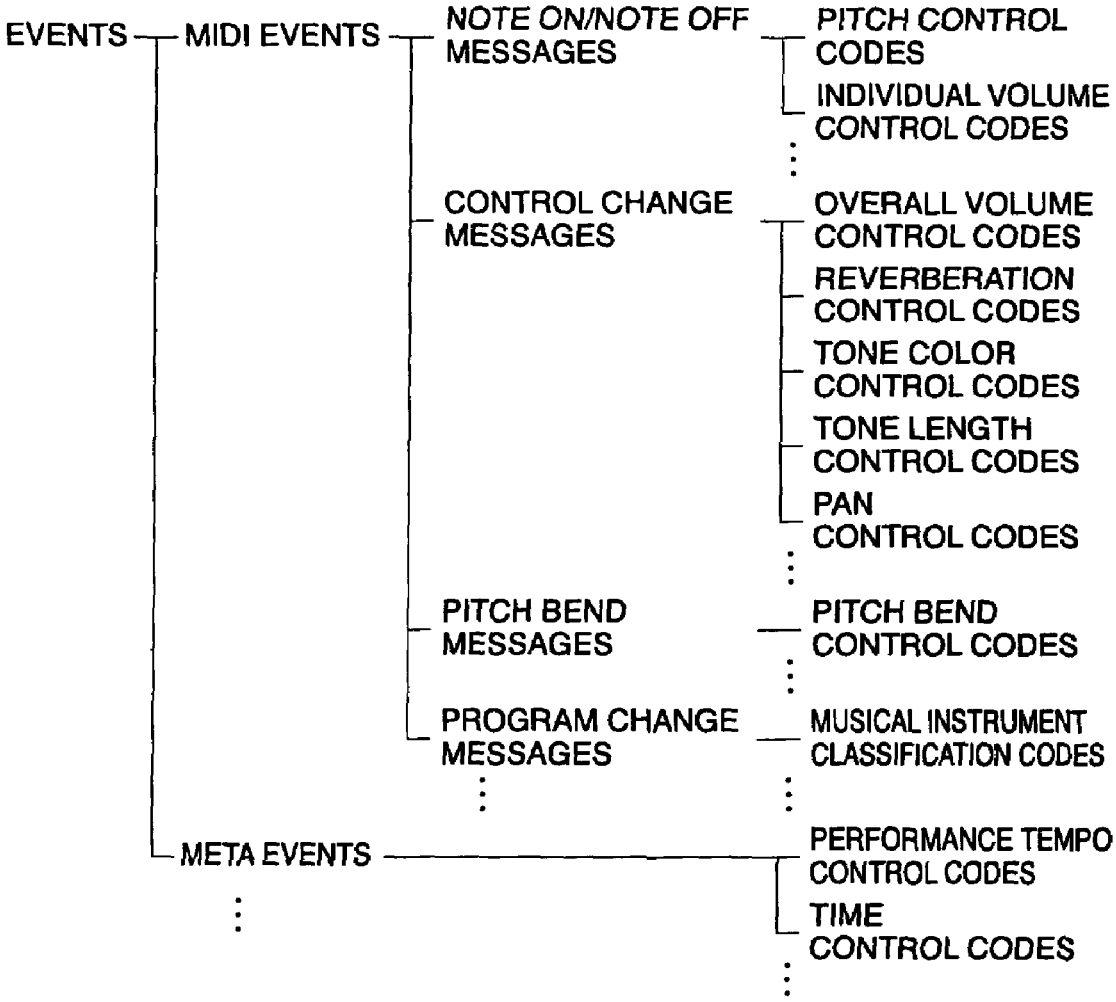

FIGS. 3A and 3B are diagrams useful in explaining the structure of the source musical composition data stored in the pre-existing musical composition data storage section 220.

As shown in FIG. 3A, the source musical composition data comprised of MIDI data or the like is time series musical composition data that is comprised of events IB that instruct performance control or the like, and delta times DT that each indicate the time interval between the preceding event and the following event. The events IB in the source musical composition data are comprised of MIDI events, meta events and so on (see FIG. 3B).

As shown in FIG. 3B, the MIDI events are comprised of messages of various kinds.

Note on/note off messages are for instructing an operation of pressing a prescribed key (note on) or releasing a prescribed key (note off) of a keyboard or the like, and are comprised of pitch control codes indicating the pitch of a tone to be sounded or the like, and individual volume control codes indicating the volume of a tone to be sounded or the like. Note that the length of a tone (which corresponds to a musical note) to be sounded or the like is determined by the delta time; by referring to the value of the delta time, it is determined whether or not each note has a staccato, a slur, a fermata, a tenuto or the like imparted thereto (this will be described in detail later).

Control change messages are for informing of the movement of any of various operating knobs, switches, pedals and so on attached to the keyboard or the like, and are comprised of overall volume control codes for adjusting the overall volume (the so-called main volume), reverberation control codes indicating the depth and so on of reverberation to be imparted, tone color control codes indicating the strength and so on of "chorus" which gives a tone depth, tone length control codes for adjusting changes in volume (crescendo, decrescendo, etc.) in terms of performance, expression, pan control codes for adjusting the volume balance between left and right channels, and so on. Note that in the following description, the individual volume control codes and the overall volume control codes will be sometimes referred to collectively merely as "volume control codes".

Pitch bend messages are for freely shifting the pitch of a tone to realize a smooth change in pitch like choking of a guitar, whistling of a wind instrument or sliding thereof, and are comprised of pitch bend control codes and so on indicating the amount of change in the pitch of the tone and so on.

Program change messages are for deciding the type of a tone generator, i.e. the type of a musical instrument, used when sounding, and are comprised of musical instrument classification codes indicating the type of a musical instrument and so on.

On the other hand, as shown in FIG. 3B, meta events are comprised of information other than that on MIDI events, specifically performance tempo control codes for controlling the performance tempo (e.g. 60 beats per minute), time control codes indicating the time of the musical composition (e.g. 4/4), and so on.

As described above, the source musical composition data contains various control codes for realizing the musical image of the creator of the musical composition. It should be noted that in the claims and in the following description, control codes for controlling the reproduction of a musical composition such as performance tempo control codes, volume control codes, tone color control codes, tone length control codes and musical instrument classification codes are referred to as "musical composition reproduction control codes", and control codes for controlling acoustics such as reverberation control codes and pan control codes are referred to as "acoustic control codes".

Returning to FIG. 2, a standard musical composition data generating section 230 reads out source musical composition data from the pre-existing musical composition data storage section 220, and generates standard musical composition data based on the read out source musical composition data, under the control of the control section 210.

Figure 4:
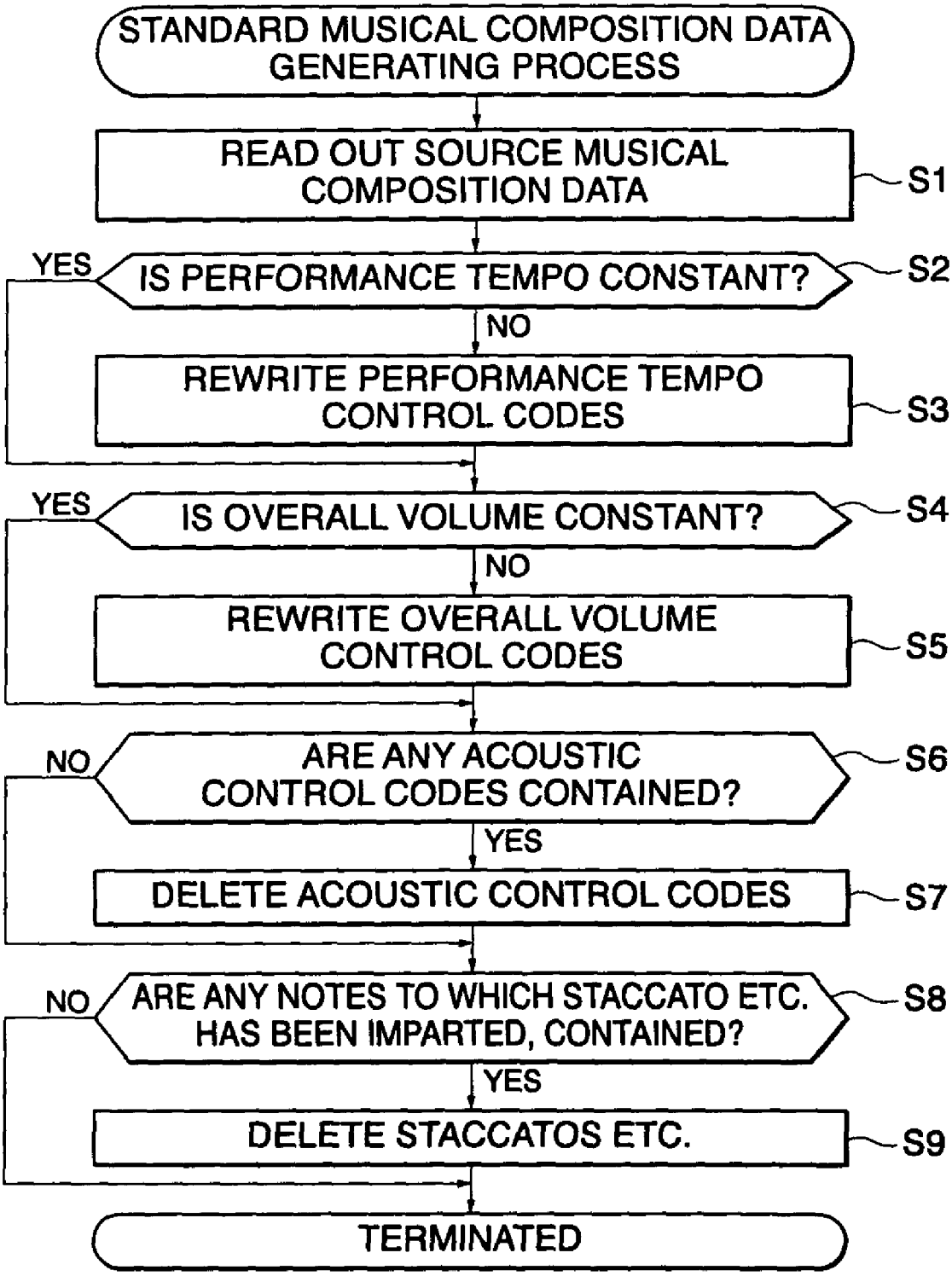
FIG. 4 is a flowchart showing a standard musical composition data generating process.

FIG. 4 is a flowchart showing the standard musical composition data generating process carried out by the standard musical composition data generating section 230.

Upon receiving an instruction for reading out predetermined source musical composition data from the control section 210, the standard musical composition data generating section 230 reads out corresponding source musical composition data from the pre-existing musical composition data storage section 220 in accordance with this instruction (step S1). The standard musical composition data generating section 230 then refers to the performance tempo control codes contained in the source musical composition data, and determines whether or not the performance tempo is constant throughout the whole of the musical composition (step S2). If the standard musical composition data generating section 230 determines that the performance tempo is to change during reproduction of the musical composition ("NO" at step S2), then the standard musical composition data generating section 230 carries out rewriting of the performance tempo control codes such that the performance tempo becomes constant throughout the whole of the musical composition (step S3). On the other hand, if the standard musical composition data generating section 230 determines that the performance tempo is constant throughout the whole of the musical composition ("YES" at step S2), then the process skips step S3 and proceeds to step S4.

In step S4, the standard musical composition data generating section 230 refers to the overall volume control codes contained in the source musical composition data, and determines whether or not the overall volume is constant throughout the whole of the musical composition. If the standard musical composition data generating section 230 determines that the overall volume is to change during the musical composition ("NO" at step S4), then the standard musical composition data generating section 230 carries out rewriting of the overall volume control codes such that the overall volume becomes constant throughout the whole of the musical composition (step S5). On the other hand, if the standard musical composition data generating section 230 determines that the overall volume is constant throughout the whole of the musical composition ("YES" at step S4), then the process skips step S5 and proceeds to step S6.

In step S6, the standard musical composition data generating section 230 determines whether or not acoustic control codes such as reverberation control codes are contained in the source musical composition data. If the standard musical composition data generating section 230 determines that such acoustic control codes are contained in the source musical composition data ("YES" at step S6), then the standard musical composition data generating section 230 carries out rewriting of the acoustic control codes such that the acoustics such as the reverberation becomes constant throughout the whole of the musical composition (step S7). On the other hand, if the standard musical composition data generating section 230 determines that such acoustic control codes are not contained in the source musical composition data ("NO" at step S6), then the process skips step S7 and proceeds to step S8. Note that regarding the acoustic control codes to be searched for and rewritten to be constant in value in steps S6 and S7, all of the types of acoustic control codes contained in the source musical composition data may be searched for and rewritten to be constant in value, or alternatively only acoustic control codes of some types (e.g. reverberation control codes and/or pan control codes) may be searched for and rewritten to be constant in value.

In step S8, the standard musical composition data generating section 230 refers to the delta times contained in the source musical composition data, and determines whether or not there are notes that have a staccato, a slur, a fermata, a tenuto or the like imparted thereto.

Figures 5, 6:
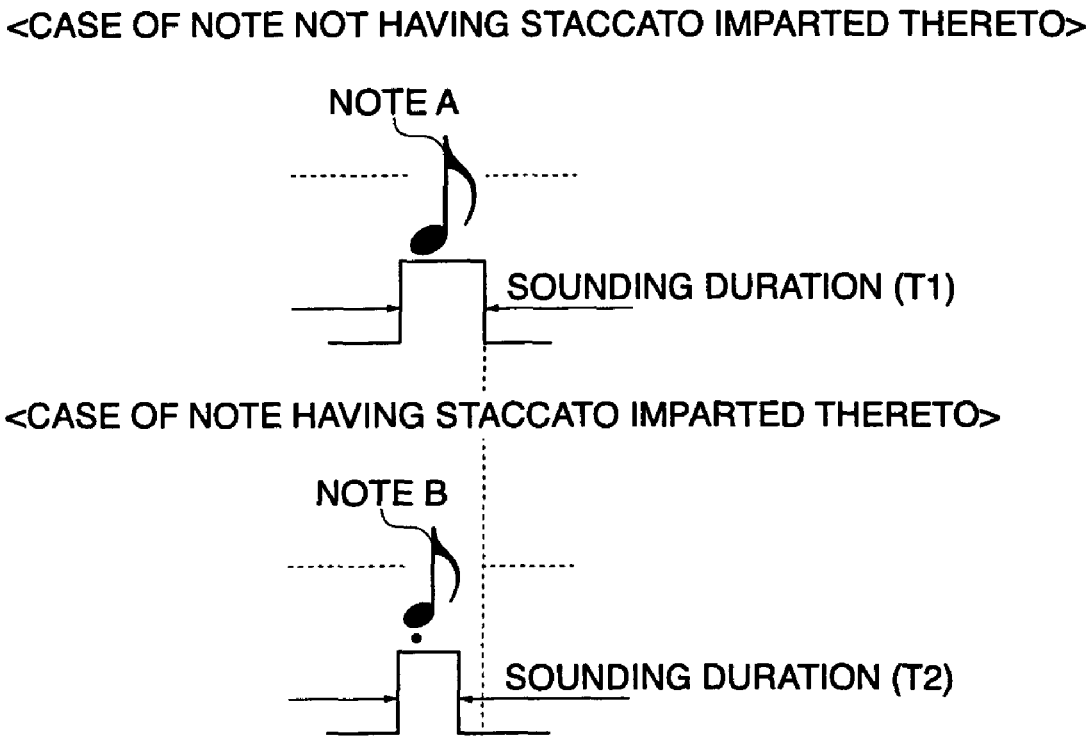
FIG. 5 is a diagram useful in comparing a note to which staccato has been imparted and a note to which staccato has not been imparted.
FIG. 6 is a diagram showing an example of a musical composition data list.

FIG. 5 is a diagram useful in comparing the duration T1 for which a note to which a staccato has not been imparted (eighth note A) actually sounds, and the duration T2 for which a note to which a staccato has been imparted (eighth note B) actually sounds.

As shown in FIG. 5, despite both being eighth notes, the duration T2 for which eighth note B to which a staccato has been imparted actually sounds is shorter than the duration T1 for which eighth note A to which a staccato has not been imparted actually sounds. This is because the delta time corresponding to the eighth note B to which a staccato has been imparted is set to be shorter than the delta time corresponding to the eighth note A to which a staccato has not been imparted. The standard musical composition data generating section 230 determines whether or not an eighth note targeted for determination has a staccato imparted thereto by utilizing this difference in delta time.

Specifically, for each eighth note in the musical composition targeted for determination, the standard musical composition data generating section 230 calculates the time difference between the delta time corresponding to that eighth note targeted for determination and a standard delta time, which is the delta time corresponding to an eighth note to which a staccato has not been imparted. If the standard musical composition data generating section 230 determines that the calculated time difference is more than a predetermined value, then the standard musical composition data generating section 230 determines that the eighth note in question has a staccato imparted thereto, whereas if the calculated time difference is not more than the predetermined value, then the standard musical composition data generating section 230 determines that the eighth note in question does not have a staccato imparted thereto. By carrying out this process, the standard musical composition data generating section 230 can determine whether or not each eighth note has a staccato imparted thereto.

In FIG. 5, eighth notes were given as examples of the notes that have or do not have a staccato imparted thereto, but the process described above can be applied to any other notes as well (e.g. quarter notes). Moreover, the delta times corresponding to each type of note (eighth note, quarter note, etc.) when that note does not have a staccato imparted thereto may be stored in advance in the standard musical composition data generating section 230 in the form of a table. Moreover, the determination process can also be carried out for slurs, fermatas, tenutos and so on based on similar logic to that described above for the case of staccatos, and hence description of this will be omitted here.

Returning to FIG. 4, the standard musical composition data generating section 230 refers to the delta time corresponding to each note in the musical composition, and in the case of finding notes having a staccato, a slur, a fermata, a tenuto or the like imparted thereto ("YES" at step S8), deletes the staccato, slur, fermata, tenuto or the like for each such note by rewriting the delta time corresponding to that note to be the standard delta time (step S9); the standard musical composition data generating process is then terminated. On the other hand, if the standard musical composition data generating section 230 does not find any notes having a staccato, a slur, a fermata, a tenuto or the like imparted thereto ("NO" at step S8), then step S9 is skipped and the standard musical composition data generating process is terminated.

Through the process described above being carried out by the standard musical composition data generating section 230, standard musical composition data having the following characteristic features (a) to (c) is generated.

(a) The performance tempo, the time, and the overall volume have been made constant throughout the whole of the musical composition.

(b) Acoustic control codes for controlling acoustics have been constant.

(c) Staccatos, slurs, fermatas, tenutos and so on have been deleted.

Returning to FIG. 2, a standard musical composition data storage section 240 stores the standard musical composition data generated by the standard musical composition data generating section 230. Moreover, a musical composition data list R that shows the correspondence between the source musical composition data and the standard musical composition data is stored in the standard musical composition data storage section 240 (see FIG. 6).

Upon receiving an instruction for reading out predetermined standard musical composition data from the control section 210, a standard musical composition data readout section 250 reads out corresponding standard musical composition data from the standard musical composition data storage section 240, and outputs this standard musical composition data to an external communication section 260.

Under the control of the control section 210, the external communication section 260 distributes the standard musical composition data outputted from the standard musical composition data readout section 250 to a plurality of performing apparatuses PS (or a single performing apparatus PS) via the network NW.

The functional construction of the contents server CS has been described above. A description will now be given of the hardware construction of the contents server CS for realizing the functions described above.

Figure 7:
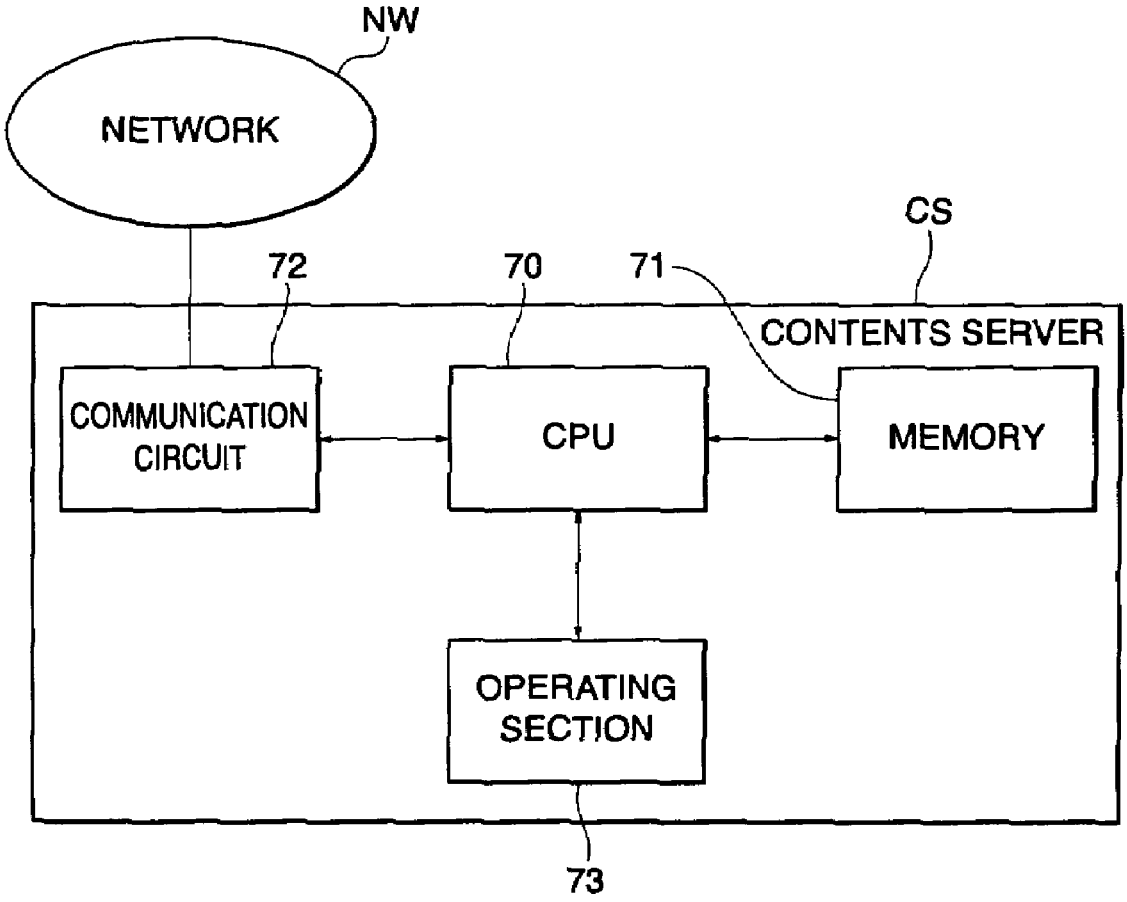
FIG. 7 is a diagram showing the hardware construction of the contents server.

FIG. 7 is a diagram showing the hardware construction of the contents server CS.

A CPU 70 controls various sections of the contents server CS in accordance with various control programs and so on stored in a memory 71. The CPU 70 thus realizes the functions of the control section 210, the standard musical composition data generating section 230, and the standard musical composition data readout section 250, described above.

The memory 71 is composed of a nonvolatile memory such as a ROM or a volatile memory such as a RAM, and has stored therein various control programs including a program for implementing the standard musical composition data generating process described above, tables and so on. The memory 71 thus realizes the functions of the preexisting musical composition data storage section 220 and the standard musical composition data storage section 240, described above.

A communication circuit 72 is connected to the network NW by an exclusive line or the like, and under the control of the CPU 70, distributes standard musical composition data stored in the memory 71 to the performing apparatuses PS via the network NW, and also receives requests for the distribution of standard musical composition data sent from the performing apparatuses PS via the network NW. Together with the CPU 70, the communication circuit 72 thus realizes the functions of the external communication section 260 described above.

An operating section 73 is comprised, for example, of a keyboard and/or a mouse and/or various operating buttons, and enables various setting operations relating to generation of the standard musical composition data and so on to be carried out.

FIG. 8 is a diagram showing the functional construction of a performing apparatus PS.

As shown in FIG. 8 and FIG. 1, the performing apparatus PS is comprised of a musical tone generating device MS, and a plurality of operating terminals OU-k (k=1 to n) that are provided in association with the musical tone generating device MS. Note that in the case that it is not particularly necessary to distinguish between the various operating terminals OU-k, they will merely be referred to as "the operating terminals OU".

Each operating terminal OU (see FIG. 9) is a portable terminal that is gripped by an operator by hand or mounted on a portion of an operator's body.

As shown in FIG. 8, each operating terminal OU has a motion sensor 310 and a radio communication section 320. The motion sensor 310 detects motion based on the motion of the operator carrying the operating terminal OU and generates corresponding motion information, and sequentially outputs the motion information to the radio communication section 320. The motion sensor 310 may be composed of a known three-dimensional acceleration sensor, three-dimensional velocity sensor, two-dimensional acceleration sensor, two-dimensional velocity sensor, strain sensor, or the like.

The radio communication section 320 carries out data communication by radio communication with the musical tone generating device MS. Upon receiving motion information corresponding to motion of the operator from the motion sensor 310, the radio communication section 320 adds to the motion information an ID for identifying the operating terminal OU and then transmits the motion information to the musical tone generating device MS by radio communication.

The musical tone generating device MS edits standard musical composition data that has been received from the contents server CS via the network NW, based on the motion information transmitted from the operating terminal OU, and carries out tone generation based on the edited musical composition data (see FIG. 8).

Referring to FIG. 8, an external communication section 410 receives standard musical composition data distributed from the contents server CS via the network NW, and transfers the received standard musical composition data to a standard musical composition data storage section 420.

The standard musical composition data storage section 420 stores the standard musical composition data transferred from the external communication section 410.

A radio communication section 430 receives motion information transmitted from each operating terminal OU, and outputs the received motion information to an information analysis section 440.

The information analysis section 440 carries out a predetermined analysis process, described later, on the motion information supplied from the radio communication section 430, and outputs the analysis results to a standard musical composition data editing section 450.

The standard musical composition data editing section 450 carries out editing of the standard musical composition data in accordance with the motion information analysis results supplied from the information analysis section 440, and sequentially outputs the edited musical composition data (hereinafter referred to as "original musical composition data") to a tone generating section 470, and also transfers the original musical composition data to an original musical composition data storage section 460. Describing the standard musical composition data editing operation in more detail, the standard musical composition data editing section 450 determines performance tempo, volume, depth of reverberation to be imparted and so on from the motion information analysis results supplied from the information analysis section 440, and carries out rewriting of the control codes contained in the standard musical composition data based on the determination results.

The original musical composition data storage section 460 stores the original musical composition data transferred from the standard musical composition data editing section 450 that has been obtained by editing in accordance with the user's musical image.

The tone generating section 470 receives the original musical composition data supplied from the standard musical composition data editing section 450, sequentially generates tone signals based on the received original musical composition data, and externally outputs the tone signals as tones.

A description will now be given of the hardware construction of the operating terminal OU and the musical tone generating device MS for realizing the functions described above.

Figure 9:
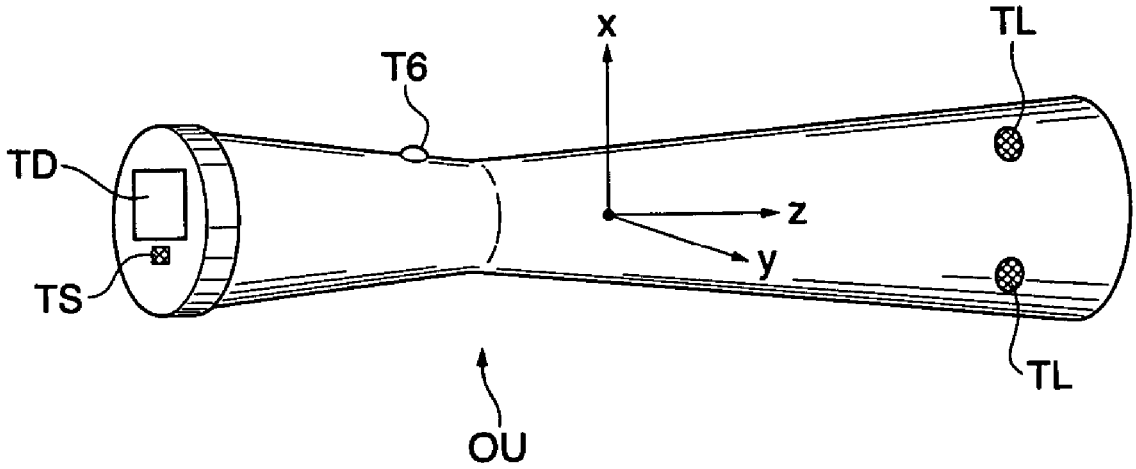
FIG. 9 is a perspective view showing the appearance of an operating terminal appearing in FIG. 1.
Figure 10:
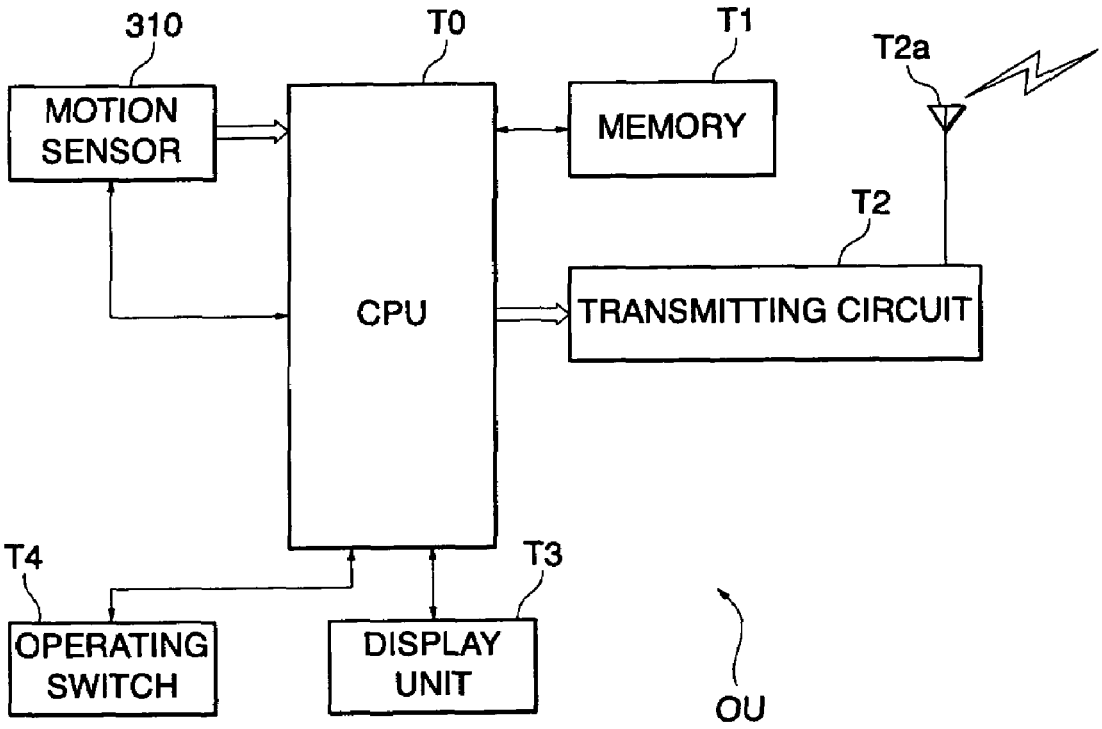
FIG. 10 is a block diagram showing the hardware construction of the operating terminal.

FIG. 9 is a perspective view showing the appearance of the operating terminal OU, and FIG. 10 is a block diagram showing the hardware construction of the operating terminal OU.

As shown in FIG. 9, the operating terminal OU according to the present embodiment is a so-called handheld type operating terminal that is used by the operator gripped in his/her hand. The operating terminal OU is comprised of a base portion (shown on the left in FIG. 9) and an end portion (shown on the right in FIG. 9), and has a tapered shape such that the two ends have larger diameters and a central portion has a smaller diameter.

The base portion has a smaller mean diameter than that of the end portion so as to be easily gripped by hand, and functions as a gripping portion. An LED (light emitting diode) display device TD and a power switch TS for a battery power source are provided on the outer surface of a bottom portion of the base portion (shown on the far left in FIG. 3), and an operating switch T6 is provided on the outer surface of the central portion. Moreover, in the vicinity of the tip of the end portion, a plurality of LEDs TL are provided. The operating terminal OU having such a tapered shape has various devices incorporated therein.

The internal hardware construction of the operating terminal OU will now be described with reference to FIG. 10. A CPU T0 controls various sections of the operating terminal OU including the motion sensor 310 based on various control programs stored in a memory T1, which is comprised of a ROM, a RAM and the like. Moreover, the CPU T0 also has other functions including a function of adding an ID for identifying the operating terminal OU to motion information sent from the motion sensor 310.

The motion sensor 310 is composed of a three-dimensional acceleration sensor or the like, and outputs motion information corresponding to the direction, magnitude and speed of an operation made by the operator holding the operating terminal OU in his/her hand. It should be noted that although in the present embodiment the motion sensor 310 is incorporated in the operating terminal OU, the motion sensor 310 may instead be mounted on a freely chosen part of the operator's body.

A transmitting circuit T2 is comprised of a radio frequency transmitter, an electric power amplifier (neither of which is shown in FIG. 10) and others in addition to an antenna T2A, and has a function of transmitting, to the musical tone generating device MS, the motion information to which the ID supplied from the CPU T0 has been added, and other functions. Together with the CPU T0, the transmitting circuit T2 thus realizes the functions of the radio communication section 320 shown in FIG. 8.

A display-unit T3 is comprised of the LED display device TD and the plurality of LEDs TL (see FIG. 9), and displays various information such as a sensor number, an "in operation" indication and a "battery low" indication, under the control of the CPU T0. An operating switch T4 is used for switching the power source of the operating terminal OU on and off, setting various modes, and the like. Driving power is supplied to the various component elements described above from a battery power source, not shown. Either a primary battery or a rechargeable secondary battery may be used as the battery power source.

Figure 11:
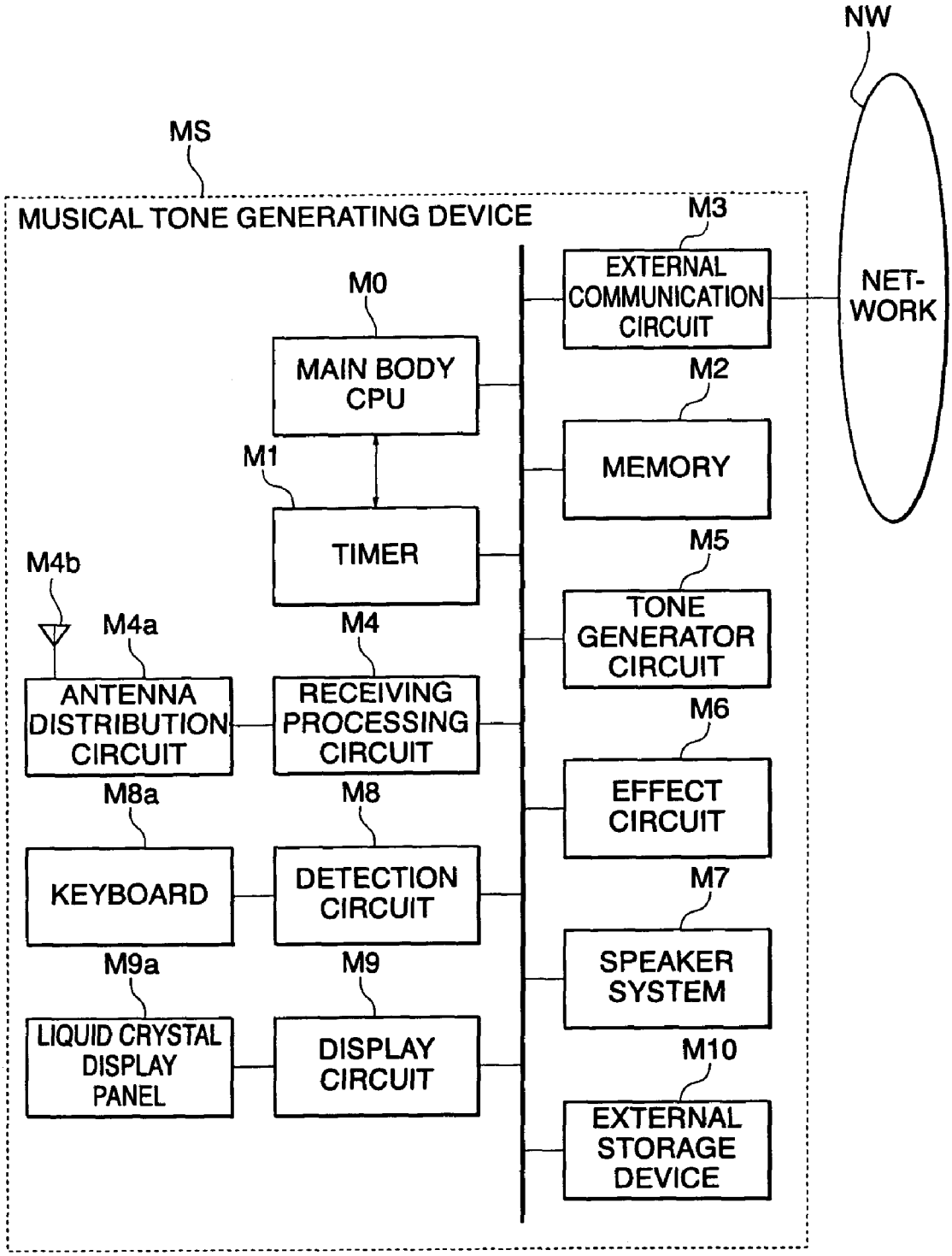
FIG. 11 is a block diagram showing the hardware construction of a musical tone generating device appearing in FIG. 1.

FIG. 11 is a block diagram showing the hardware construction of the musical tone generating device MS.

The musical tone generating device MS has functions like those of an ordinary personal computer, and also has other functions including a network connection function and a musical tone generating function.

The musical tone generating device MS has a main body CPU M0 for controlling various sections of the musical tone generating device MS. The main body CPU M0 carries out various kinds of control in accordance with predetermined programs under time control by a timer M1, which is used to generate a tempo clock, an interrupt clock, and the like. Moreover, in accordance with various control programs stored in a memory M2, the main body CPU M0 also analyzes the motion information transmitted from each operating terminal OU that represents the motion of the body of the operator carrying that operating terminal OU, and determines performance tempo, volume, depth of reverberation to be imparted and so on from the motion information analysis results. The main body CPU M0 then carries out rewriting of the various control codes contained in the standard musical composition data based on the determination results, thus generating original musical composition data. The main body CPU M0 thus realizes the functions of the information analysis section 440 and the standard musical composition data editing section 450 shown in FIG. 8.

The memory M2 is comprised of a nonvolatile memory such as a ROM and a volatile memory such as a RAM, and has stored therein the predetermined control programs for controlling the musical tone generating device MS, the standard musical composition data distributed from the contents server CS via the network NW, the original musical composition data generated by editing the standard musical composition data, and so on. The memory M2 thus realizes the functions of the standard musical composition data storage section 420 and the original musical composition data storage section 460 shown in FIG. 8. The above control programs include a control program used by the main body CPU M0 for analyzing the motion information, and a control program used by the main body CPU M0 for determining the performance tempo, the volume, the depth of reverberation to be imparted and so on based on the motion information analysis results, and carrying out the rewriting of the various control codes contained in the standard musical composition data based on the determination results.

An external communication circuit M3 is comprised of an interface circuit, a modem, and the like, and receives the standard musical composition data distributed from the contents server CS via the network NW, and also transmits standard musical composition data distribution requests and so on to the contents server CS via the network NW. Together with the main body CPU M0, the external communication circuit M3 thus realizes the functions of the external communication section 410 shown in FIG. 8.

A receiving and processing circuit M4 has connected thereto an antenna distribution circuit M4A that is comprised, for example, of a multi-channel high-frequency receiver.

The receiving and processing circuit M4 receives the motion information transmitted from each operating terminal OU via an antenna M4B and the antenna distribution circuit M4A, and carries out predetermined signal processing on the received signals. Together with the main body CPU M0, the receiving processing circuit M4, the antenna distribution circuit M4A and the antenna M4B thus realize the functions of the radio communication section 430 shown in FIG. 8.

A tone generator circuit M5 and an effect circuit M6 are comprised of a tone generator LSI, a DSP or the like, and generate tone signals based on the musical composition data that has been edited in accordance with the operator's motion, i.e. the original musical composition data, and output these tone signals to a speaker system M7. The speaker system M7 is comprised of a D/A converter, an amplifier and so on, and externally outputs the tone signals generated by the tone generator circuit M5 and the effect circuit M6 as tones. Together with the main body CPU M0, the tone generator circuit M5, the effect circuit M6 and the speaker system M7 thus realize the functions of the tone generating section 470 shown in FIG. 8.

A detection circuit M8 has a keyboard M8A connected thereto. An operator uses the keyboard M8A to carry out various setting operations, for example, setting of various modes required for performance data control, assignment of processes/functions corresponding to the IDs identifying the operating terminals OU, and setting of tone colors (tone generators) for performance tracks. A display circuit M9 has a liquid crystal display panel M9A connected thereto. Various information relating to the standard musical composition data currently being edited and so on is displayed on the liquid crystal display panel M9A.

An external storage device M10 is comprised of at least one storage device such as a hard disk drive (HDD), a compact disk read only memory (CD-ROM) drive, a floppy disk drive (FDD: registered trademark), a magneto-optical (MO) disk drive, and a digital versatile disk (DVD) drive, and is able to store the various control programs, the edited musical composition data, and so on. The performance parameters, the various control programs and so on can thus be stored not only in the memory M2 but also in the external storage device M10.

A detailed description of the hardware construction of the operating terminal OU and the musical tone generating device MS has been given above. A description will now be given of the motion information analysis process, the standard musical composition data editing process, and the musical tone generating process (these processes will be collectively referred to as the "musical composition data editing and tone generating process"), for the case of using a three-dimensional acceleration sensor as the motion sensor 310, with reference to FIG. 8 and other figures.

Figure 12:
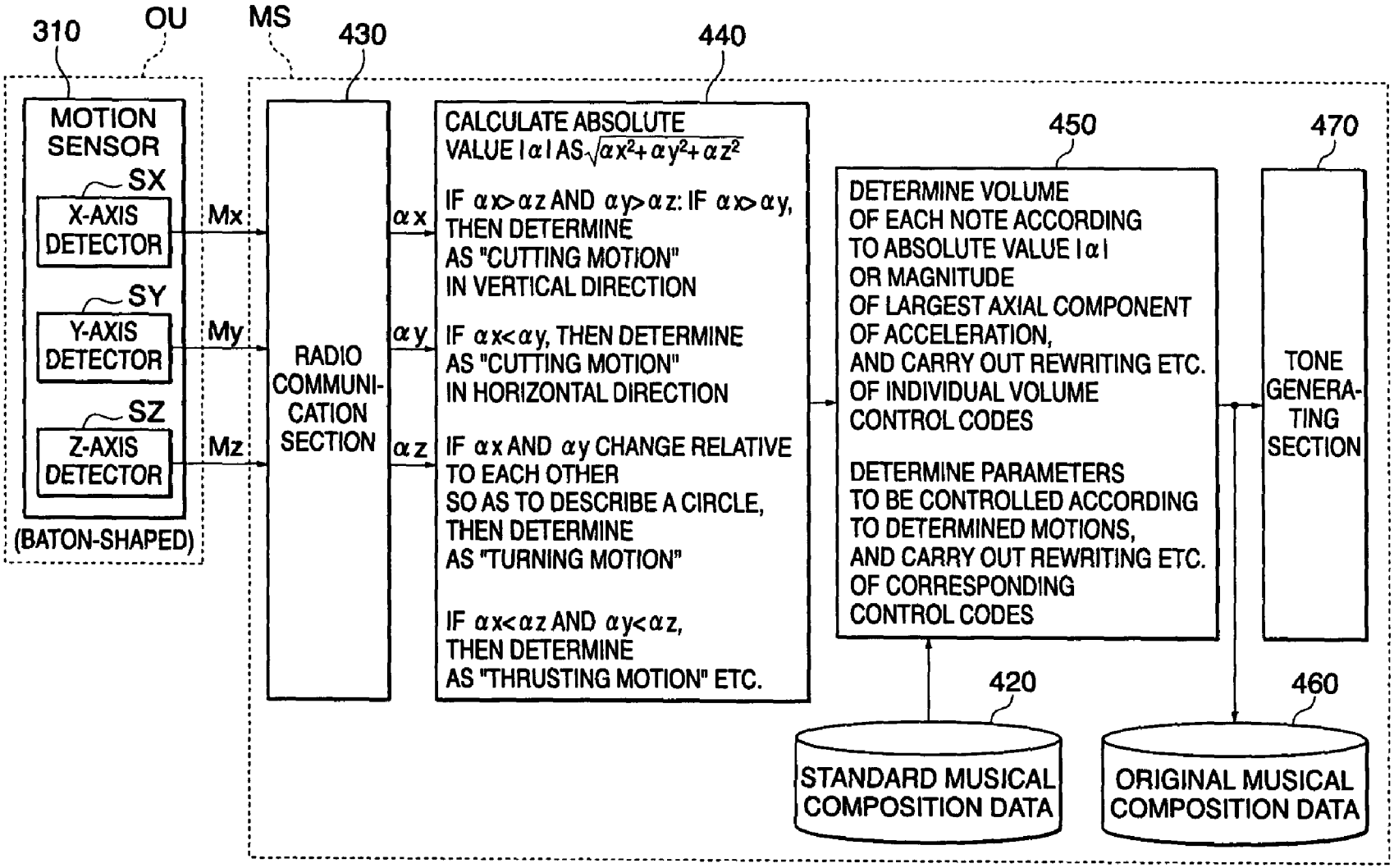
FIG. 12 is a diagram useful in explaining a musical composition data editing and tone generating process.

FIG. 12 is a functional block diagram useful in explaining the editing of the standard musical composition data using the motion sensor. 310, and the tone generation based on the edited musical composition data (i.e. the original musical composition data).

When an operator holds by hand and operates the operating terminal OU having the motion sensor 310 incorporated therein, motion information corresponding to the direction and force of the operator's operation is transmitted from the operating terminal OU to the musical tone generating device MS. More specifically, signals Mx, My and Mz representing the acceleration $\alpha_x$ in the x-axis direction (vertical), the acceleration $\alpha_y$ in the y-axis direction (left/right), and the acceleration $\alpha_z$ in the z-axis direction (forward/backward) are outputted from an x-axis detector SX, a y-axis detector SY, and a z-axis detector SZ of the motion sensor 310 in the operating terminal OU.

The CPU T0 adds an ID to each of the signals Mx, My and Mz outputted from the motion sensor 310 to generate motion information, and transmits the motion information to the musical tone generating device MS through radio communication via the transmitting circuit T2. Upon receiving the motion information to which the IDs have been added via the antenna M4B, the radio communication section 430 of the musical tone generating device MS refers to a table, not shown, and compares the IDs added to the received motion information and IDs registered in the table. After verifying from the comparison results that IDs the same as those added to the motion information are registered in the table, the radio communication section 430 outputs the motion information to the information analysis section 440 as acceleration data $\alpha_x$, $\alpha_y$ and $\alpha_z$.

The information analysis section 440 analyzes the acceleration data for each axis received from the radio communication section 430, and calculates the absolute value $|\alpha|$ of the acceleration, which is represented by undermentioned equation (1).

$$|\alpha|=(\alpha_x*\alpha_x+\alpha_y*\alpha_y+\alpha_z*\alpha_z)^{1/2} \quad (1)$$

Next, the information analysis section 440 compares the accelerations $\alpha_x$ and $\alpha_y$ with the acceleration $\alpha_z$. If the comparison result shows, for example, that the relationships of undermentioned expression (2) hold, i.e. that the acceleration $\alpha_z$ in the z-axis direction is greater than both the acceleration $\alpha_x$ in the x-axis direction and the acceleration $\alpha_y$ in the y-axis direction, then it is determined that the operator's motion is a "thrusting motion" of thrusting the operating terminal OU forward.

$$\alpha_x<\alpha_z, \text{ and } \alpha_y<\alpha_z \quad (2)$$

Conversely, if the acceleration $\alpha_z$ in the z-axis direction is lower than the acceleration $\alpha_x$ in the x-axis direction and the acceleration $\alpha_y$ in the y-axis direction, then it is determined that the operator's motion is a "cutting motion" of cutting through the air with the operating terminal OU. In this case, by further comparing the accelerations $\alpha_x$ and $\alpha_y$ in the x- and y-axis directions with each other, it may be determined whether the direction of the "cutting motion" is vertical (the x-axis direction) (when $\alpha_x>\alpha_y$) or horizontal (the y-axis direction) (when $\alpha_y>\alpha_x$).

Moreover, in addition to comparing the x-, y- and z-axis direction acceleration components $\alpha_x$, $\alpha_y$ and $\alpha_z$ with one another, the values of $\alpha_x$, $\alpha_y$ and $\alpha_z$ may also each be compared with a predetermined threshold value; if the threshold value is exceeded, then it may be determined that the operator's motion is a "combined motion" that combines the motions described above. For example, if $\alpha_z>\alpha_x$ and $\alpha_z>\alpha_y$, and furthermore $\alpha_x$>"threshold value for x-component", then it is determined that the operator's motion is a "thrusting and cutting motion" of thrusting forward while cutting through the air in a vertical direction (the x-axis direction). If $\alpha_z<\alpha_x$ and $\alpha_z<\alpha_y$, and furthermore $\alpha_x$>"threshold value for x-component" and $\alpha_y$>"threshold value for y-component", then it is determined that the operator's motion is a "diagonal cutting motion" of cutting through the air in the x- and y-axis directions simultaneously. Furthermore, by detecting a phenomenon in which the values of the accelerations $\alpha_x$, and $\alpha_y$ in the x- and y-axis directions change relative to each other so as to describe a circular trajectory, it can be determined that the operator's motion is a "turning motion" of turning the operating terminal OU round and round.

The standard musical composition data editing section 450 carries out editing of predetermined standard musical composition data (e.g. standard musical composition data a' (see FIG. 6) selected by the operator at his/her discretion) read out from the standard musical composition data storage section 420, carrying out this editing based on the determination results of the analysis process carried out by the information analysis section 440. For example, the standard musical composition data editing section 450 determines the volume of each tone in accordance with the magnitude of the absolute value $|\alpha|$ of the acceleration or the magnitude of the largest of the acceleration components $\alpha_x$, $\alpha_y$ and $\alpha_z$, and carries out rewriting of the individual volume control codes contained in the standard musical composition data accordingly.

Moreover, the standard musical composition data editing section 450 determines the other control codes based on the determination results as follows. For example, the standard musical composition data editing section 450 determines the performance tempo according to the repetition period of the cutting motion in the vertical (x-axis) direction, and carries out rewriting of the performance tempo control codes contained in the standard musical composition data such that reproduction of the musical composition is carried out at the determined performance tempo. Moreover, separate to this, if it is determined that such a vertical cutting motion is a small, quick motion, then the standard musical composition data editing section 450 adds a reverberation control code, or in the case that a reverberation control code is already present, carries out rewriting of the reverberation control code, so that a reverberation effect is imparted. Moreover, if it is determined that the vertical cutting motion is a large, slow motion, then the standard musical composition data editing section 450 carries out rewriting of a pitch control code such that the pitch is raised or lowered. Moreover, if it is determined that the operator's motion is a cutting motion in the horizontal (y-axis) direction, then the standard musical composition data editing section 450 carries out rewriting of a delta time contained in the standard musical composition data so as to impart a slur effect.

Furthermore, if it is determined that the operator's motion is a thrusting motion, then the standard musical composition data editing section 450 carries out rewriting of the delta time such that the tone generation duration is shortened in accordance with the timing of the thrusting motion, thus imparting a staccato effect, or else the standard musical composition data editing section 450 generates a new MIDI event and inserts this MIDI event into a predetermined place in the standard musical composition data so as to insert a single sound (e.g. a percussive sound, a shout, etc.) according to the magnitude of the thrusting motion into the musical composition performance. Moreover, if it is determined that the operator's motion is a combined motion of a cutting motion in the horizontal (y-axis) direction and a thrusting motion, then the standard musical composition data editing section 450 carries out rewriting of various acoustic control codes contained in the standard musical composition data such that the types of control described above are applied in combination.

Moreover, if it is determined that the operator's motion is a turning motion, and moreover that the repetition period of the turning motion is more than a predetermined repetition period, then the standard musical composition data editing section 450 carries out rewriting of a time control code so as to change the time of the musical composition according to the repetition period; on the other hand, if it is determined that the repetition period of the turning motion is not more than the predetermined repetition period, then the standard musical composition data editing section 450 adds or rewrites a control code to generate a trill according to the repetition period. It should be noted that these types of control are only given by way of example, and in addition, for example, to control dynamics (crescendo, decrescendo, etc.) according to the local peak value of the acceleration for each axis, rewriting of tone length control codes may be carried out according to a peak Q value that indicates the sharpness of the local peak.

After the standard musical composition data editing section 450 has carried out rewriting of the various control codes contained in the standard musical composition data based on the analysis results supplied from the information analysis section 440 as described above to generate original musical composition data that reflects the musical image of the operator, the standard musical composition data editing section 450 transfers the original musical composition data to the original musical composition data storage section 460, and also outputs the original musical composition data to the tone generating section 470.

The original musical composition data storage section 460 stores the original musical composition data transferred from the standard musical composition data editing section 450. On the other hand, the tone generating section 470 generates musical tone signals based on the original musical composition data supplied from the standard musical composition data editing section 450, and externally outputs the musical tone signals as tones. As a result, musical tones of a performance that reflects the musical image of the operator are sequentially sounded from the musical tone generating device MS.

As described above, according to the system 100 of the present embodiment, the contents server CS generates standard musical composition data from pre-existing musical composition data (source musical composition data), and distributes the standard musical composition data to the performing apparatus PS.

The standard musical composition data is musical composition data in which the musical composition reproduction control codes have been rewritten such that the performance tempo, volume and so on are constant throughout the whole of the musical composition, and acoustic control codes for controlling acoustic effects have been rewritten such that acoustics and so on become constant through the whole of the musical composition. The musical composition data targeted for performance thus does not contain any control codes or the like that reflect the musical image of the creator of the source musical composition data, and hence a user who carries out performance of the musical composition using the performing apparatus PS can cause his/her own musical image to be reflected in the performance of the musical composition, and can impart various acoustics to the performance of the musical composition, through simple operations using a portable operating terminal OU. By adopting the system 100, it is thus possible to satisfy a wide variety of users from beginners having no knowledge of musical composition data such as MIDI data to experts who want to arrange musical compositions in their own manner.

The first embodiment of the present invention described above is merely an example, and various modifications may be made thereto, so long as they fall within the scope of the present invention.

In the first embodiment described above, standard musical composition data generated by the contents server CS is distributed automatically to each performing apparatus PS. However, as a second embodiment of the present invention, it may be arranged such that a performing apparatus PS requests the distribution of predetermined standard musical composition data, and then the contents server CS distributes the predetermined standard musical composition data to the performing apparatus PS in accordance with the request.

Figure 13:
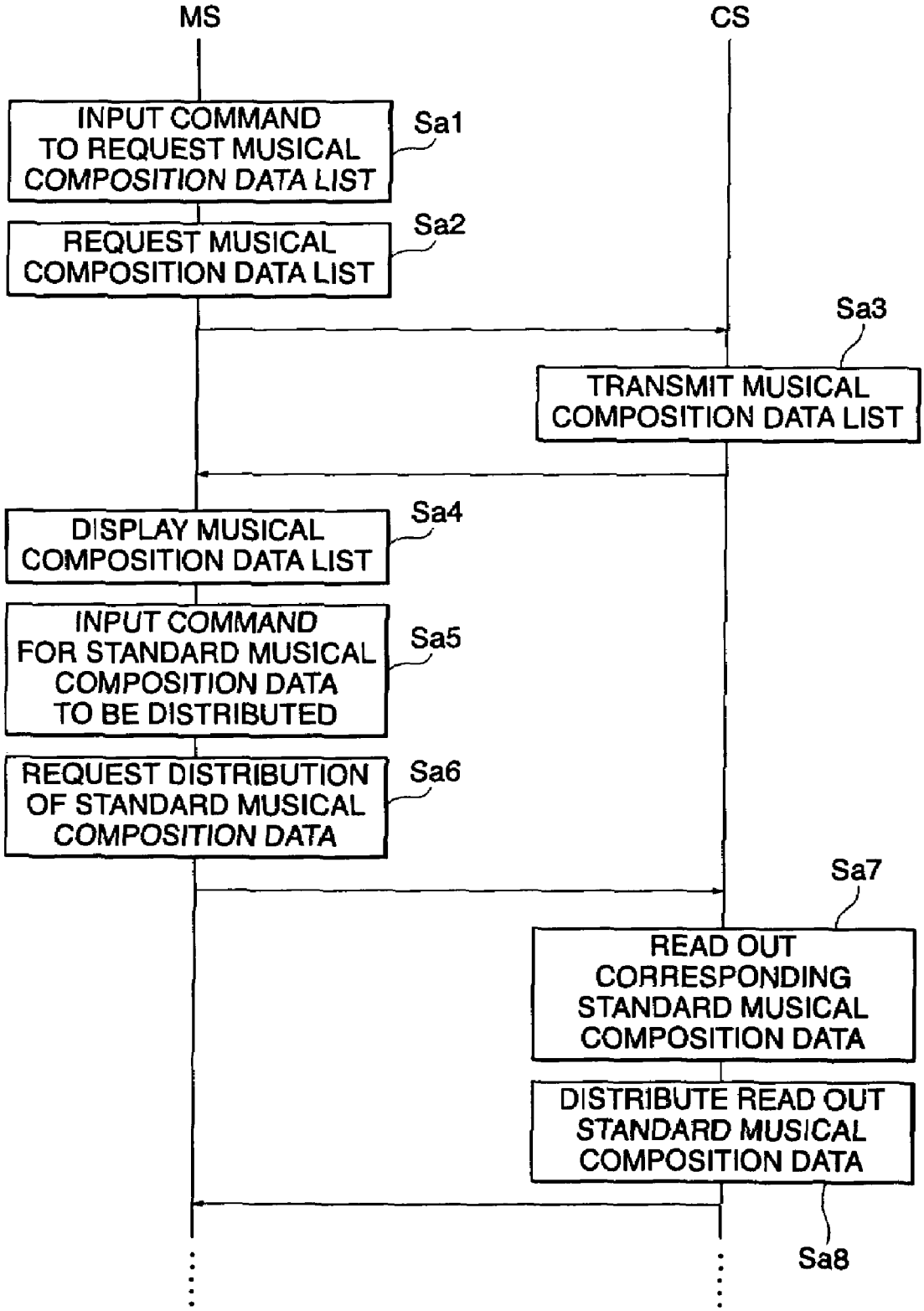
FIG. 13 is a flowchart useful in explaining a standard musical composition data distribution operation carried out by a musical composition data distributing apparatus according to a second embodiment of the present invention.

FIG. 13 is a flowchart useful in explaining the standard musical composition data distribution operation according to the second embodiment of the present invention.

A user (operator) carrying out musical composition performance using the performing apparatus PS first operates the keyboard M8A or the like of the musical tone generating apparatus MS of the performing apparatus PS to input a command to request a list of standard musical composition data that can be distributed (step Sa1). In accordance with the command, the main body CPU M0 of the tone generating apparatus MS then sends a request to the contents server CS for the list of standard musical composition data that can be distributed (step Sa2). Upon receiving the request via the network NW, the CPU 70 of the contents server CS reads out the musical composition data list R stored in the memory 71 (see FIG. 6), and transmits (notifies) this to the tone generating apparatus MS via the network NW (step Sa3).

Upon receiving the musical composition data list R via the receiving processing circuit M4, the main body CPU M0 of the tone generating apparatus MS causes the musical composition data list R to be displayed on the liquid crystal display panel M9A (step Sa4). The user then selects standard musical composition data that is to be requested to be distributed from out of the contents server CS displayed on the liquid crystal display panel M9A, and inputs a command for the selected standard musical composition data to be distributed (step Sa5). In accordance with the inputted command, the main body CPU M0 sends a request to the contents server CS to distribute the standard musical composition data in question (e.g. standard musical composition data a' in FIG. 6) (step Sa6). Upon receiving the request via the network NW, the CPU 70 of the contents server CS searches through the memory 71 and reads out the standard musical composition data corresponding to the request (step Sa7). The CPU 70 then distributes the read out standard musical composition data to the tone generating apparatus MS via the network NW (step Sa8). The processing after the standard musical composition data has been transmitted to the tone generating apparatus MS can be carried out in a similar manner to as in the first embodiment described earlier, and hence description is omitted.

Moreover, as a third embodiment of the present invention, it may be arranged such that original musical composition data generated in accordance with the musical image of an operator is uploaded to the contents server CS (or another server), and this original musical composition data is posted on a homepage (web site) and thus made publicly open to other operators, whereby the publicly open original musical composition data can be distributed to the other operators in accordance with their wishes. Furthermore, a contest or the like regarding the original musical composition data uploaded to the contents server CS (or other server) may be carried out, thus giving the various operators an opportunity to make their own music public.

Moreover, in the standard musical composition data generating process according to the first embodiment described above (see FIG. 4), in step S6, if the standard musical composition data producing part 230 determines that acoustic control codes are contained in the source musical composition data ("YES" at step S6), then the acoustic control codes contained in the source musical composition data are rewritten such that acoustics or the like are constant through the whole of the musical composition. However, as a fourth embodiment of the present invention, instead of rewriting the acoustic control codes, the acoustic control codes may be deleted.

Moreover, in the first embodiment described above, rewriting is carried out of some of the musical composition reproduction control codes such that the performance tempo and the volume become constant throughout the whole of the musical composition. However, as a fifth embodiment of the present invention, rewriting of other musical composition reproduction control codes such as tone color control codes and tone length control codes may be carried out. Alternatively, as with the acoustic control codes, the musical composition reproduction control codes contained in the source musical composition data may be deleted.

Furthermore, as a sixth embodiment of the present invention, it may be arranged such that only the acoustic control codes are rewritten (or deleted) and the musical composition reproduction control codes are not rewritten (or deleted). Alternatively, as a seventh embodiment of the present invention, it may be arranged such that only the musical composition reproduction control codes are rewritten (or deleted) and the acoustic control codes are not rewritten (or deleted).

Moreover, in the first embodiment of the present invention described above, performance tempo control codes, volume control codes and so on are given as examples of musical composition reproduction control codes, and reverberation control codes, pan control codes and so on are given as examples of acoustic control codes, but these are merely examples. For example, as an eighth embodiment of the present invention, rewriting (or deletion) may be carried out of any of various other kinds of musical composition reproduction control codes relating to the control of the reproduction of the musical composition, and any of various other kinds of acoustic control codes relating to the imparting of acoustic effects, for example modulation depth control codes for imparting an effect in which the pitch wavers slightly.

Moreover, the various functions of the contents server CS and so on according to the first to eighth embodiments of the present invention described above may also be implemented through programs executed by a computer. For example, in the case of using a program for executing the standard musical composition data generating process shown in FIG. 4, the program may be installed from a storage medium storing the program, or may be installed by being downloaded via the network NW from a server storing the program. The standard musical composition data generating process shown in FIG. 4 may then be carried out by executing the installed program. As a result, the various functions of the contents server CS described above can be implemented using the installed program. Examples of the storage medium storing the program include a ROM, a floppy (registered trademark) disk, a hard disk, an optical disk, a magneto-optical disk, a CD-ROM, a CD-R, a CD-RW, a DVD-ROM, a DVD-RAM, a DVD-RW, a DVD+RW, a magnetic tape, and a nonvolatile memory card.

What is claimed is:

1. A musical composition data editing apparatus comprising:

a determining device that reads out whole of source musical composition data and refers to musical composition reproduction control codes for controlling reproduction of a musical composition contained in the source musical composition data, to determine whether or not the musical composition reproduction control codes are constant throughout the whole of the musical composition; and a rewriting device that is responsive to having been determined by said determining device that the imaging in the musical composition reproduction control codes are not constant throughout the whole of the musical composition, for carrying out rewriting of at least one of the musical composition reproduction control codes such that the at least one of the control codes becomes constant throughout the whole of the musical composition.

2. A musical composition data editing apparatus as claimed in claim 1, wherein the musical composition reproduction control codes referred to by said determining device include performance tempo control codes, and said rewriting device is responsive to having been determined by said determining device that a performance tempo in the musical composition reproduction changes, for carrying out rewriting of the performance tempo control codes such that the performance tempo becomes constant.

3. A musical composition data editing apparatus as claimed in claim 1, wherein the musical composition reproduction control codes referred to by said determining device include volume control codes, and said rewriting device is responsive to having been determined by said determining device that a volume in the musical composition reproduction changes, for carrying out rewriting of the volume control codes such that the volume becomes constant.

4. A program encoded on a computer-readable medium for implementing a musical composition data editing method, comprising:

a determining module that reads out whole of source material composition data and refers to musical composition reproduction control codes for controlling reproduction of a musical composition contained in the source musical composition data, to determine whether or not the musical composition reproduction control codes are constant throughout the whole of the musical composition; and a rewriting module responsive to having been determined by said determining module that the musical composition reproduction control codes are not constant throughout the whole of the musical composition, for carrying out rewriting of at least one of the musical composition reproduction control codes such that the at least one of the control codes becomes constant throughout the whole of the musical composition.

5. A musical composition data editing apparatus comprising:

a determining device that reads out whole of source musical composition data and determines whether or not acoustic control codes for controlling effects are contained in the source musical composition data; and a control code rewriting device that is responsive to having been determined by said determining device that the acoustic control codes are not constant throughout the whole of the musical composition, for carrying out rewriting of at least one of the acoustic control codes such that effects in reproduction of a musical composition contained in the source musical composition data becomes constant throughout the whole of the musical composition.

6. A program encoded on a computer-readable medium for implementing a musical composition data editing method, comprising:

a determining module that reads out whole of source musical composition data and determines whether or not acoustic control codes for controlling effects are contained in source musical composition data; and a control code rewriting module responsive to having been determined by said determining module that the acoustic control codes are contained in the source musical composition data are not constant throughout the whole of the musical composition, for carrying out rewriting of at least one of the acoustic control codes such that effects in reproduction of a musical composition contained in the source musical composition data becomes constant throughout the whole of the musical composition.

7. A musical composition data distributing apparatus for distributing musical composition data in a predetermined instrument and performance control format to at least one performing apparatus, comprising:

a control code deleting device that reads out the whole of source musical composition data and is operable when at least one of musical composition reproduction control codes for controlling musical composition reproduction and acoustic control codes for controlling effects is contained in the source musical composition data and not constant throughout the whole of the musical composition data, for deleting at least one of the musical control codes from the source musical composition data to generate musical composition data in said predetermined format; and a distributing device that distributes the musical composition data to the performing apparatus.

8. A musical composition data distributing apparatus as claimed in claim 7, further comprising a transmitting device that transmits distributable musical composition data to the performing apparatus in response to a request from the performing apparatus.

9. A musical composition data distributing apparatus for distributing musical composition data in a predetermined instrument and performance control format to at least one performing apparatus, comprising:

a control code deleting device that is operable when at least one of musical control code is contained in source musical composition data, for deleting at least one of the musical control codes from the source musical composition data to generate musical composition data in said predetermined format; and a distributing device that distributes the musical composition data to the performing apparatus, wherein the performing apparatus comprises a musical tone generating device that receives the musical composition data from said musical composition data distributing device, edits the received musical composition data, and generates musical tones based on the edited musical composition data, and at least one operating terminal carriable by an operator, that generates information for controlling editing of the musical composition data by said musical tone generating device;

said operating terminal having a transmitting section that is operable during the editing of the musical composition data to detect motion of said operating terminal caused by an operation of the operator, generate motion information based on the detected motion, and transmit the motion information to said musical tone generating device; and said musical tone generating device having an imparting section that parses the generated motion information into different types of motions and maps those different types of motions onto different musical control codes, the imparting section being further operative to newly generate musical control codes based on the motion information received from said operating terminal and according to the motion type-control code mapping, and imparts the generated musical control codes to the musical composition data.

10. A musical composition data distributing apparatus for distributing musical composition data in a predetermined instrument and performance control format to at least one performing apparatus, comprising:

a control code rewriting device that reads out whole of source musical composition data and is operable when at least one of musical composition reproduction control codes for controlling musical composition reproduction and acoustic control codes for controlling effects is contained in the source musical composition data and not constant throughout the whole of the musical composition data, for carrying out rewriting of the at least one of the musical composition reproduction control codes and the acoustic control codes such that at least one of a musical composition reproduction state and the effects become constant, to generate musical composition data in said predetermined format; and a distributing device that distributes the musical composition data to the performing apparatus.

11. A musical composition data distributing apparatus as claimed in claim 10, further comprising a transmitting device that transmits distributable musical composition data to the performing apparatus in response to a request from the performing apparatus.

12. A musical composition data distributing apparatus for distributing musical composition data in a predetermined instrument and performance control format to at least one performing apparatus, comprising:

a control code rewriting device that is operable when at least one of musical composition reproduction control codes for controlling musical composition reproduction and acoustic control codes for controlling effects is contained in source musical composition data and at least one of imaging and effects in the musical composition reproduction changes, for carrying out rewriting of at least one of the musical composition reproduction control codes and the acoustic control codes such that at least one of a musical composition reproduction state and the effects become constant, to generate musical composition data in said predetermined format; and a distributing device that distributes the musical composition data to the performing apparatus, wherein the performing apparatus comprises a musical tone generating device that receives the musical composition data from said musical composition data distributing device, edits the received musical composition data, and generates musical tones based on the edited musical composition data, and at least one operating terminal carriable by an operator, that generates information for controlling editing of the musical composition data by said musical tone generating device;

said operating terminal having a transmitting section that is operable during the editing of the musical composition data to detect motion of said operating terminal caused by an operation of the operator, generate motion information based on the detected motion, and transmit the motion information to said musical tone generating device; and said musical tone generating device having a rewriting section that parses the generated motion information into different types of motions and maps those different types of motions onto different musical control codes, the rewriting section being further operative to newly generate musical control codes based on the motion information received from the operating terminal, according to the motion type-control code mapping, and to replace the newly generated musical control codes for existing musical control codes contained in the musical composition data to be the newly generated musical control codes.

* * * * *